United States Patent [19]

Tsurusaki

[11] Patent Number: 4,793,318

[45] Date of Patent: Dec. 27, 1988

[54] DIAGNOSTIC SYSTEM FOR EXHAUST GAS RECIRCULATION DEVICE

[75] Inventor: Shinji Tsurusaki, Toyokawa, Japan

[73] Assignee: Toyota Jidosha Kabushiki Kaisha, Aichi, Japan

[21] Appl. No.: 124,046

[22] Filed: Nov. 23, 1987

[30] Foreign Application Priority Data

Nov. 26, 1986 [JP] Japan ..... 61-279617
Jul. 31, 1987 [JP] Japan ..... 62-190308

[51] Int. Cl.[4] ..... F02M 25/06
[52] U.S. Cl. ..... 123/571; 364/431.06
[58] Field of Search ..... 123/568, 569, 571; 364/431.06

[56] References Cited

U.S. PATENT DOCUMENTS

| | | | |
|---|---|---|---|
| 4,378,776 | 4/1983 | Nishimori | 123/571 |
| 4,428,355 | 1/1984 | Yokooku | 123/571 |
| 4,442,820 | 4/1984 | Ina et al. | 123/571 |
| 4,448,177 | 5/1984 | Hasegawa et al. | 123/571 |
| 4,541,398 | 9/1985 | Kishi | 123/571 |
| 4,665,882 | 5/1987 | Otobe | 123/571 |
| 4,715,348 | 12/1987 | Kobayashi et al. | 123/571 |

FOREIGN PATENT DOCUMENTS

| | | |
|---|---|---|
| 0064623 | 9/1972 | Japan . |
| 0067220 | 10/1973 | Japan . |

*Primary Examiner*—Willis R. Wolfe
*Attorney, Agent, or Firm*—Kenyon & Kenyon

[57] ABSTRACT

A diagnostic system of an EGR device comprising an EGR control valve in an EGR passage, and a temperature sensor arranged in the EGR passage downstream of the EGR control valve. A counter which is variable between a minimum value and a maximum value is provided. The count value of the counter is incremented from the minimum value toward the maximum value when the engine is operating in a state where the recirculation of the EGR gas is to be carried out. When a difference between the temperature detected by the temperature sensor when the count value is equal to the minimum value and the temperature detected by the temperature sensor when the count value becomes equal to the maximum value is lower than a predetermined value, it is determined that a malfunction has occurred in the EGR device.

20 Claims, 9 Drawing Sheets

DIAGNOSTIC SYSTEM FOR EXHAUST GAS RECIRCULATION DEVICE

BACKGROUND OF THE INVENTION

1. Field of the Invention

The present invention relates to a diagnostic system for an exhaust gas recirculation device.

2. Description of the Related Art

Conventionally, to reduce the amount of $NO_X$ in the exhaust gas, an exhaust gas recirculation (hereinafter referred to as an EGR) device, in which the exhaust gas is recirculated into the intake passage of an engine via the EGR passage, is employed. In such an EGR device, an EGR control valve is normally arranged in the EGR passage to control the amount of EGR gas to be fed into the intake passage. However, in such an EGR device, the EGR control valve can be damaged or become clogged, and thus the supply of the EGR gas is stopped, and if the supply of the EGR gas is not restored, a large amount of $NO_X$ will be continuously discharged. In addition, normally, a driver will not notice the stoppage of the supply of EGR gas.

Consequently, to diagnose such a malfunction of the EGR device, a diagnostic system is known in which an exhaust gas temperature sensor is arranged in the EGR passage downstream of the EGR control valve (Japanese Unexamined Utility Model publication No. 49-64623 or No. 50-67220). In this diagnostic system, if the temperature in the EGR passage downstream of the EGR control valve does not increase beyond a fixed temperature, under an engine operating state wherein the recirculating operation of the EGR gas is to be effected, it is determined that a malfunction of the EGR device has occurred. This diagnostic method makes use of the phenomenon that, when the recirculating operation of the EGR gas is carried out, the temperature in the EGR passage will increase beyond the fixed temperature.

However, in this diagnostic system, where the temperature of the exhaust gas itself is low, even if control of the supply of the EGR gas is correctly carried out, the temperature in the EGR passage will not increase beyond the fixed temperature. As a result, it is determined that the EGR device has malfunctioned, and thus the diagnostic system will make an incorrect diagnosis. To avoid this problem, the fixed temperature used to determine the occurrence of a malfunction can be lowered, but in this case it is always determined that the operation of the EGR device is normal, and thus it is impossible carry out a diagnosis of the EGR device.

SUMMARY OF THE INVENTION

An object of the present invention is to provide a diagnostic system which is capable of correctly determining whether a malfunction has occurred in the EGR device.

According to the present invention, there is provided a diagnostic system of an exhaust gas recirculation device having an exhaust gas recirculation control valve which is arranged in an exhaust gas recirculation passage interconnecting an exhaust passage to an intake passage of an internal combustion engine, said diagnostic system comprising: first determining means for determining whether the engine is operating in a state at which the recirculation of exhaust gas is to be carried out; detecting means for detecting a temperature in the exhaust gas recirculation passage downstream of the exhaust gas recirculation control valve; count means having a count value which is variable between a predetermined first value and a predetermined second value in response to a result of a determination by said first determining means, said count value being changed from said first value toward said second value when a recirculation of exhaust gas is to be carried out; means for storing a first temperature detected by said detecting means when said count value is equal to said first value; and second determining means for obtaining a difference between said first temperature and a second temperature detected by said detecting means when said count value becomes equal to said second value, to thereby determine that a malfunction has occurred in the exhaust gas recirculation device when said difference is lower than a predetermined value.

The present invention may be more fully understood from the description of preferred embodiments of the invention set forth below, together with the accompanying drawings.

DESCRIPTION OF THE PREFERRED EMBODIMENTS

Figure 1:
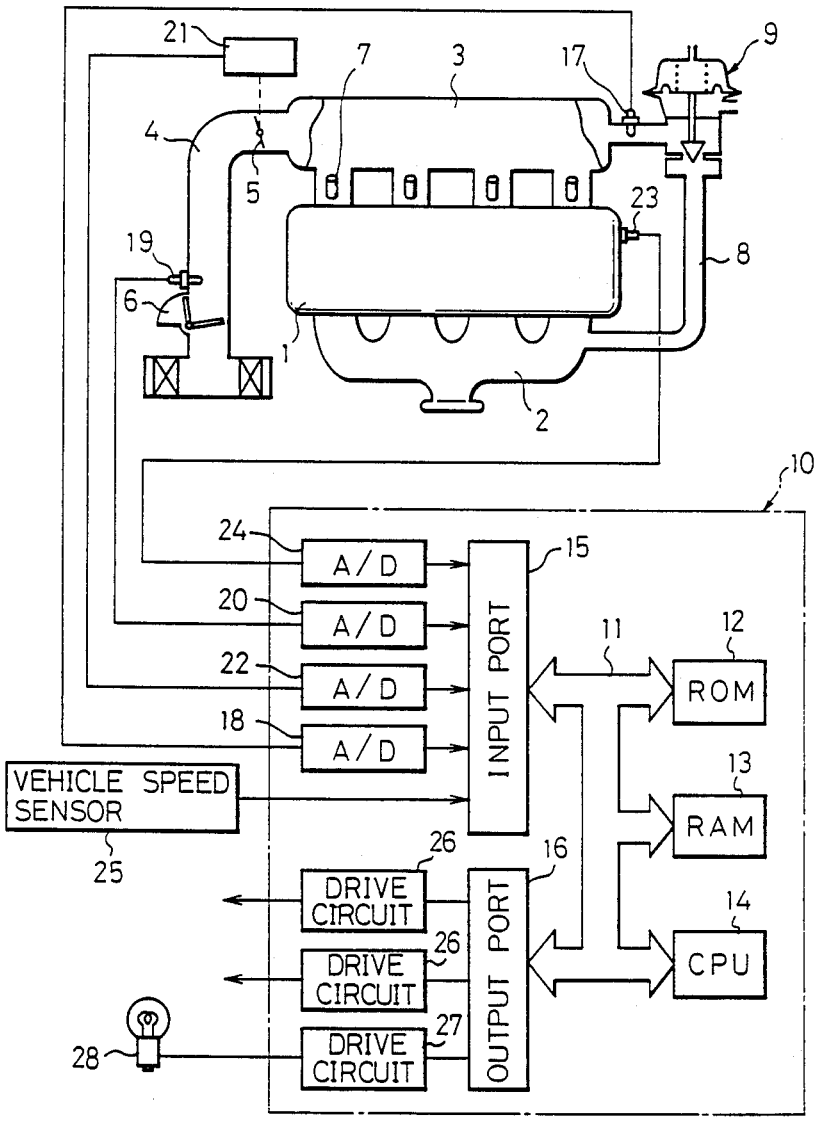
FIG. 1 is a schematically illustrated view of an embodiment of a diagnosis according to the present invention.

Referring to FIG. 1, reference numeral 1 designates an engine body, 2 an exhaust manifold, 3 an intake manifold, and 4 an intake duct; 5 designates a throttle valve arranged in the intake duct 4, 6 an air flow meter, 7 fuel injectors mounted on the branches of the intake manifold 3, and 8 an EGR passage interconnecting the intake manifold 3 and the exhaust manifold 2; 9 designates an EGR control valve arranged in the EGR passage 8, and 10 an electronic control unit. The exhaust gas in the exhaust manifold 2 is fed into the intake manifold 3 via the EGR passage 8 and the EGR control valve 9.

The electronic control unit 10 is constructed as a digital computer and comprises a ROM (read only memory) 12, a RAM (random access memory) 13, a CPU (microprocessor, etc.) 14, an input port 15 and an output port 16. The ROM 12, the RAM 13, the CPU 14, the input port 15 and the output port 16 are interconnected via a bidirectional bus 11. An exhaust gas temperature sensor 17 is arranged in the EGR passage 8 downstream of the EGR control valve 9. This sensor 17 is connected to the input part 15 via an AD converter 18. In addition, a suction air temperature sensor 19 is arranged in the intake duct 4 and connected to the input port 15 via an AD converter 20; a throttle sensor 21 detecting the opening degree of the throttle valve 5 is connected to the throttle valve 5 and connected to the input port 15 via an AD converter 22; and a cooling water temperature sensor 23 detecting the temperature of the cooling water of the engine is mounted on the engine body 1 and connected to the input port 15 via an AD converter 24. A vehicle speed sensor 25 is also connected to the input port 15. The output port 16 is connected, on one hand, to the fuel injectors 7 via corresponding drive circuits 26, and on the other hand, to a warning lamp 28 via a drive circuit 27.

Figure 2:
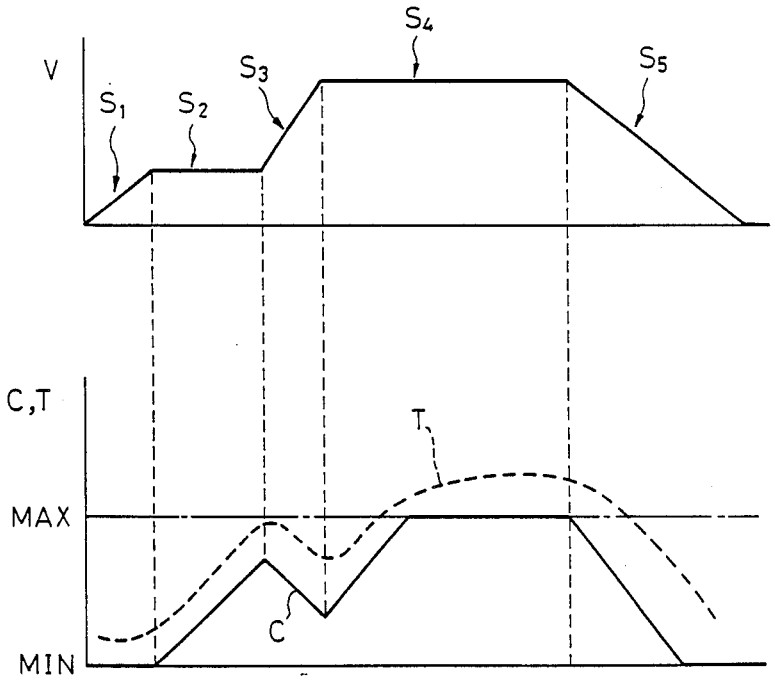
FIG. 2 is a time chart illustrating a diagnostic method carried out by using the system illustrated in FIG. 1.

The diagnostic method according to the present invention will be hereinafter described with reference to the time chart illustrated in FIG. 2. In FIG. 2, V indicates vehicle speed, C indicates the count value of a counter, and T indicates a temperature detected by the exhaust gas temperature sensor 17. FIG. 2 illustrates the case where the supply of the EGR gas is stopped at the time of acceleration and deceleration of the engine. In addition, FIG. 2 illustrates the case where the temperature of the exhaust gas is low, as the engine is operating immediately after a cold start or is operating in a cold climate.

When the engine is accelerated as illustrated by $S_1$ in FIG. 2, since the supply of the EGR gas is stopped, the temperature T is low, as illustrated by the broken line in FIG. 2. Subsequently, when a cruising operation is carried out as illustrated by $S_2$ in FIG. 2, since the EGR gas is recirculated into the intake manifold 3, the temperature T gradually rises. Then, when the engine is accelerated as illustrated by $S_3$ in FIG. 2, since the supply of the EGR gas is stopped, the temperature T falls. When the cruising operation is then carried out as illustrated by $S_4$ in FIG. 2, since the EGR gas is recirculated into the intake manifold 3, the temperature T gradually rises, and if the cruising operation is continued, the temperature T is substantially at a fixed level. When the engine is decelerated as illustrated by $S_5$ in FIG. 2, since the supply of the EGR gas is stopped, the temperature T gradually falls. As mentioned above, when control of the supply of the EGR gas is carried out in a normal manner, the temperature T varies in accordance with a change in the operating state of the engine.

The counter is controlled so that the count value C thereof is incremented or decremented between MIN and MAX. In addition, the count value C is incremented when the engine is operating in a state where the EGR gas is to be recirculated, and the count value C is decremented when the engine is operating in a state where the supply of the EGR gas is to be stopped. Consequently, it will be understood that the count value C is varied in order to follow changes in the temperature T. Where control of the supply of the EGR gas is carried out in a normal manner, when the count value C is incremented from MIN to MAX, the temperature T rises. Conversely, where the supply of the EGR gas is stopped, even if the count value C is incremented from MIN to MAX, the temperature T does not change. Consequently, if the difference between the temperature T detected when the count value C is MIN and the temperature T detected when the count value C is MAX is greater than a fixed value, it can be determined that control of the supply of the EGR gas is carried out in a normal manner and, if a difference in the temperature T is smaller than the fixed value, it can be determined that a malfunction has occurred in the EGR device.

Figure 3:
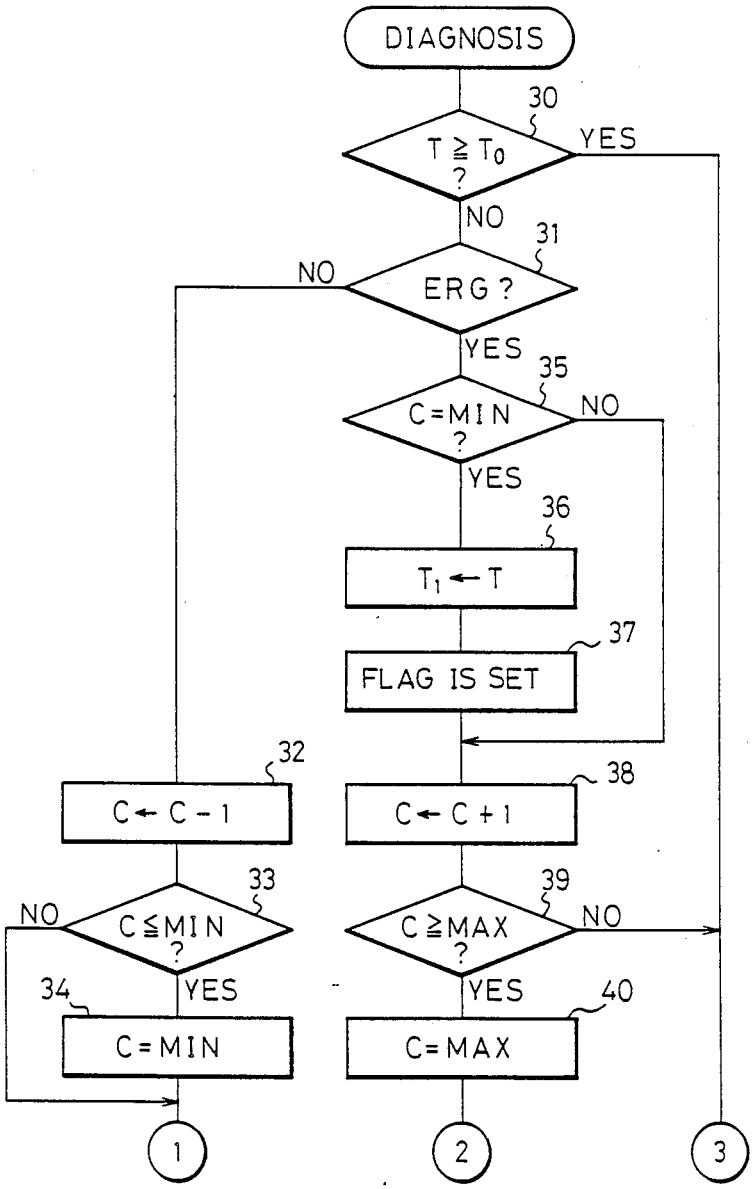
FIGS. 3 and 4 constitute a flow chart for executing the diagnostic method illustrated in the time chart of FIG. 2.
Figure 4:
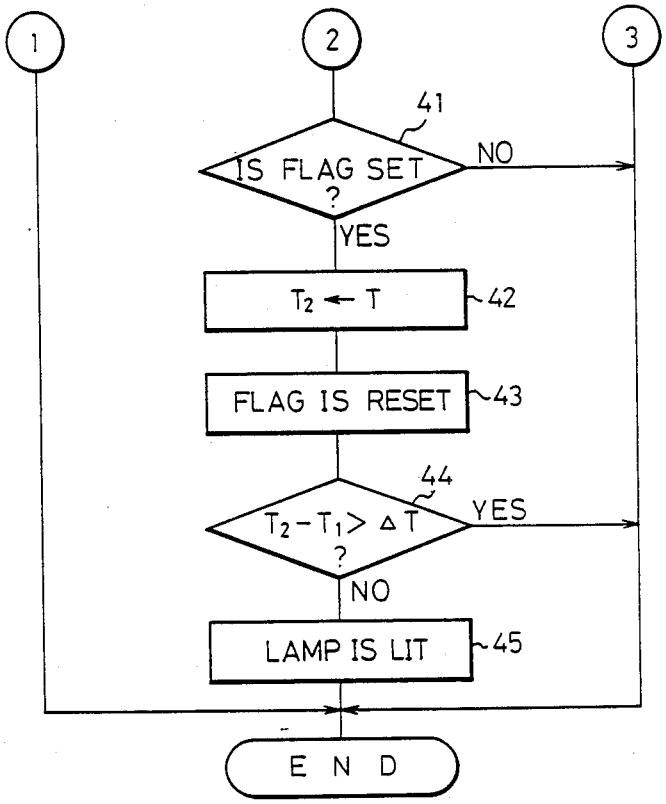

FIGS. 3 and 4 constitute a flow chart for carrying out the diagnostic method on the basis of FIG. 2. The routine illustrated in FIGS. 3 and 4 is processed by sequential interruptions which are executed at predetermined times.

Referring to FIGS. 3 and 4, in step 30, it is determined whether the temperature T detected by the exhaust gas temperature sensor 17 i higher than a predetermined fixed temperature $T_0$. If $T \geqq T_0$, the recirculating operation of the EGR gas is carried out, and consequently, the processing cycle is completed. If $T < T_0$, the routine goes to step 31, and it is determined whether the engine is operating in a state where the recirculation of the EGR gas is to be carried out on the basis of signals output from the suction air temperature sensor 19, the throttle sensor 21, the cooling water temperature sensor 23, and the vehicle speed sensor 25, and on the basis of the fuel injection time of the fuel injectors 7. When the engine is operating in a state where the supply of the EGR gas is to be stopped, the routine goes to step 32, and the count value C is decremented by one. If the count value C becomes lower than MIN, the routine goes from step 33 to step 34, and the counter value C is made MIN. Consequently, when the engine is operating in a state where the supply of the EGR gas is to be stopped, the count value C is gradually decremented, and when the count value C becomes equal to MIN, the count value C is maintained thereafter at MIN.

If it is determined in step 31 that the engine is operating in a state where the recirculation of the EGR gas is to be carried out, the routine goes to step 35, and it is determined whether the count value C is equal to MIN. If C=MIN, the routine goes to step 36, and the temperature T is memorized as $T_1$. Then, in step 37, a flag which indicates that $T_1$ has already been memorized is set, and in step 38, the count value C is incremented by one. In step 39, it is determined whether the count value is equal to or larger than MAX. If C<MAX, the processing cycle is completed. If $C \geqq MAX$, the routine goes to step 40, and the count value C is made MAX. Consequently, if the count value C is equal to MIN when the operating state of the engine is changed to a state where the recirculation of the EGR gas is to be carried out, the temperature T at the time of this change is memorized as $T_1$. Subsequently, the routine jumps to step 38 from step 35 and the count value C is gradually increased, until the count value C reaches MAX.

When the count value C becomes equal to MAX, the routine goes from step 40 to step 41, and it is determined whether the flag is set. When the flag is set if $T_1$ has been memorized in step 35, the routine goes to step 42, and the temperature T is memorized as $T_2$. Consequently, $T_2$ indicates the temperature detected when the count value C becomes equal to MAX, and in step 43, the flag is reset. Then, in step 44, it is determined whether the difference $(T_2-T_1)$ between the temperature $T_2$ detected when the count value C becomes equal to MAX and the temperature $T_1$ detected when the count value C is equal to MIN is greater than a predetermined fixed value $\Delta T$. If $(T_2-T_1) > \Delta T$, the processing routine is completed via step 41. Conversely, if $(T_2-T_1) \leqq \Delta T$, the routine goes to step 45, and data indicating that the warning lamp 28 should be lit is output to the output port 16, and the warning lamp 28 is lit.

Figure 5:
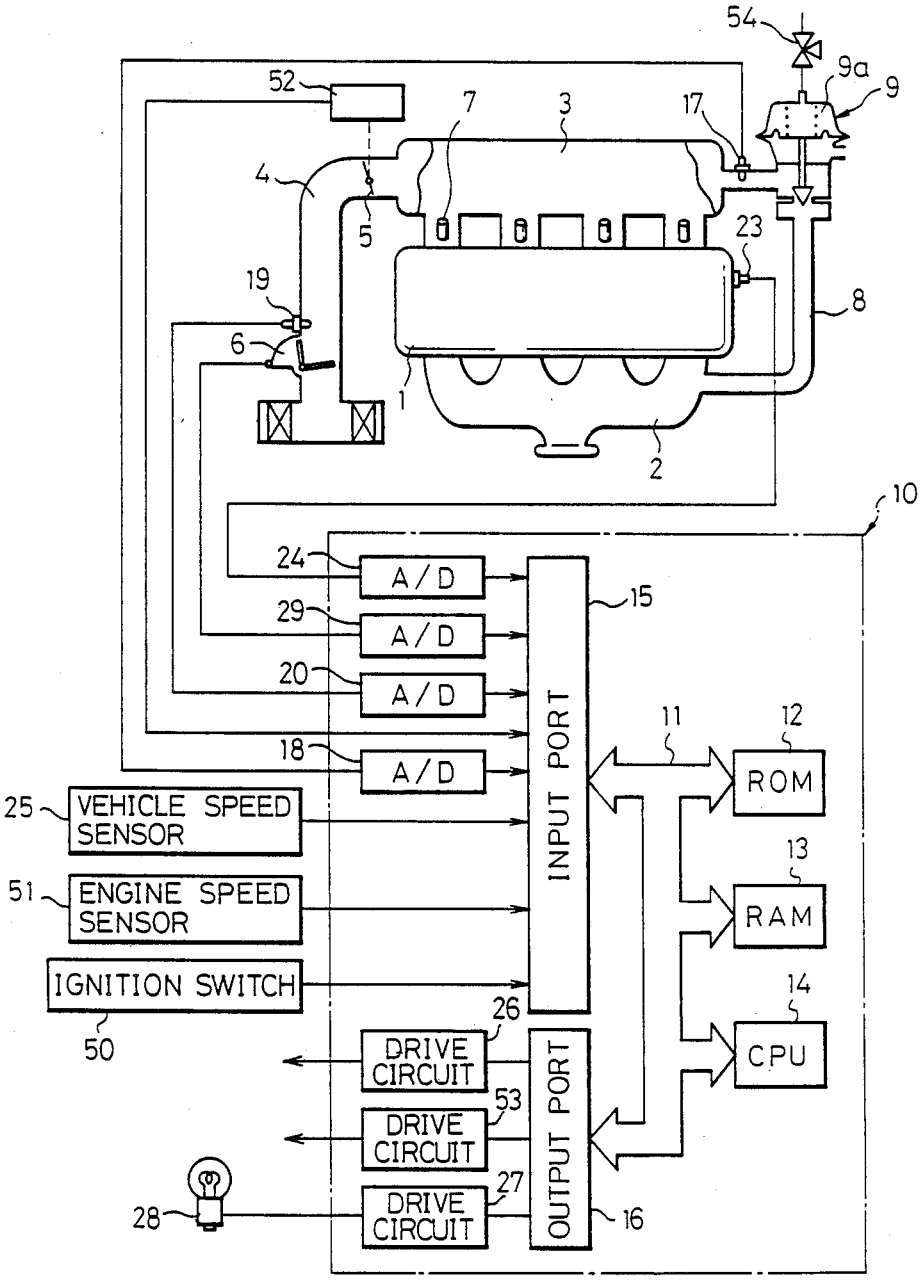
FIG. 5 is a schematically illustrated view of an alternative embodiment of a diagnosis system according to the present invention.

FIG. 5 illustrates an alternative embodiment of the present invention. In FIG. 5, similar components are indicated with the same reference numerals used in FIG. 1, and the description regarding such similar components is omitted. Referring to FIG. 5, in this embodiment the air flow meter 6 is connected to the input port 15 via an AD converter 29. In addition, an ignition switch 50 and an engine speed sensor 51, which produces an output signal indicating the engine speed, are connected to the input port 15. Furthermore, a throttle switch 52 is connected to the throttle valve 5 and connected to the input port 15. The throttle switch 52 is provided for detecting whether the degree of opening of the throttle valve 5 is smaller than a predetermined value. The output port 16 is connected via an AD converter 53 to a solenoid valve 54 which controls the level of vacuum acting on the diaphragm vacuum chamber 92 of the EGR control valve 9.

Figure 6:
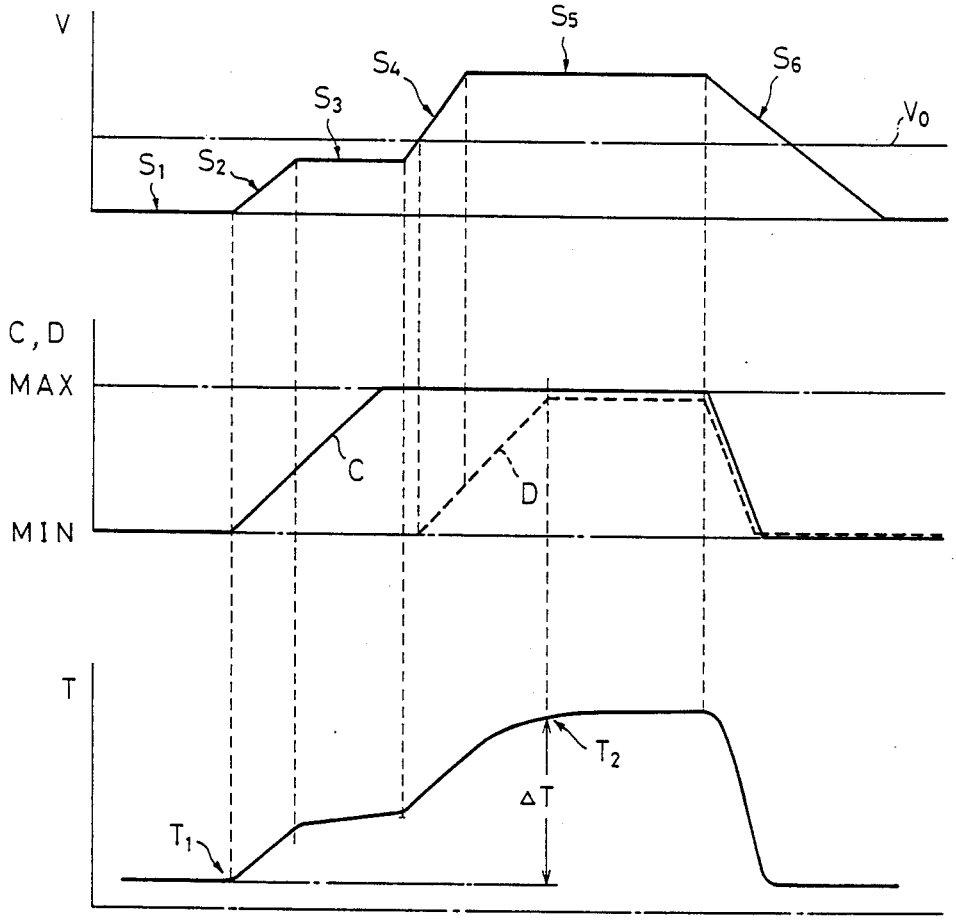
FIG. 6 is a time chart illustrating a diagnostic method carried out by using the system illustrated in FIG. 5.

The alternative embodiment of the diagnostic method according to the present invention will be hereinafter described with reference to the time chart illustrated in FIG. 6. In FIG. 6, V indicates vehicle speed, C indicates the count value of a first counter, D indicates the count value of a second counter, and T indicates a temperature detected by the exhaust gas temperature sensor 17. FIG. 6 illustrates the case where the supply of the EGR gas is stopped in an idling operating state and at the time of acceleration under a full load, as well as at the time of deceleration. In addition, FIG. 6 illustrates the case where the temperature of the exhaust gas is low as the engine is operating immediately after a cold start or in a cold climate.

When the idling operation of the engine is carried out as illustrated by $S_1$ in FIG. 6, since the supply of the EGR gas is stopped, the temperature T in the EGR passage 8 becomes low. Subsequently, when the engine is accelerated under a partial load as illustrated by $S_2$ in FIG. 6, since the EGR gas is recirculated into the intake manifold 3, the temperature T gradually rises. Then, when a cruising operation of the engine is carried out as illustrated by $S_3$ in FIG. 6, since the amount of the EGR gas recirculated into the intake manifold 3 is maintained at an approximately constant value, the temperature T is also maintained at an approximately constant value. When the engine is then accelerated under a partial load as illustrated by $S_4$ in FIG. 6, since the amount of the EGR gas recirculated into the intake manifold 3 is increased, the temperature T again starts to rise, and then, when the cruising operation of the engine is carried out as illustrated by $S_5$ in FIG. 6, since the amount of the EGR gas recirculated into the intake manifold 3 is maintained at an approximately constant value, the temperature T is also maintained at an approximately constant value.

The EGR control valve 9 is controlled so that the amount of the EGR gas recirculated int the intake manifold 3 increases as the engine load becomes high. Consequently, the amount of the EGR gas recirculated into the intake manifold 3 when the cruising operation illustrated by $S_5$ is carried out is larger than the amount of EGR gas recirculated when the cruising operation illustrated by $S_3$ is carried out, and thus the temperature T detected when the cruising operation illustrated by $S_5$ is carried out becomes higher than the temperature T detected when the cruising operation illustrated by $S_3$ is carried out. Subsequently, when the engine is decelerated as illustrated by $S_6$ in FIG. 6, since the supply of the EGR gas is stopped, the temperature T falls relatively rapidly. As mentioned above, when control of the supply of the EGR gas is carried out in a normal manner, the temperature T is varied in accordance with changes in the operating state of the engine.

The first counter is controlled so that the count value C thereof is incremented or decremented between MIN and MAX. In addition, the count value C is incremented when the engine is operating in a state where the EGR gas is to be recirculated, and the count value C is decremented when the engine is operation in a state where the supply of the EGR gas is to be stopped.

Conversely, although the second counter is also controlled so that the count value D thereof is incremented or decremented between MIN and MAX, the count value D is incremented when the engine is operating in a state where a large amount of the EGR gas is to be recirculated, and the count value D is decremented when the engine is operating in a state where a large amount of the EGR gas is not to be recirculated.

As mentioned above, when the recirculation of the EGR gas is started, the count value C increases. However, when the cruising operation of the engine is carried out at a low speed, even if the EGR gas is continuously recirculated into the intake manifold 3, the rise in the temperature T is stopped at a certain level. Consequently, the increase in the count value C is not always proportional to the rise in the temperature T and, even if the count value C becomes equal to MAX, the temperature T is not always considerably raised. Consequently, in consideration of a possibility that the temperature T is not always considerably raised even if the count value C becomes equal to MA, in the embodiment illustrated in FIGS. 1 through 4, it is necessary to determine whether a malfunction has occurred in the EGR device on the basis of a relatively small change in the temperature T.

As mentioned above, the increase in the count value C is not always proportional to a raise in the temperature T. However, where the control of the recirculating operation of tee EGR gas is carried out in a normal manner, when the supply of the EGR gas is stopped for more than a fixed time, the count value C must become equal to MIN. That is, when the count value C becomes equal to MIN, since the supply of the EGR gas has been stopped for more than a fixed time therebefore, the first temperature $T_1$ detected when the count value C becomes equal to MIN must be low. Conversely, the count value D becomes equal to MAX when a large amount of the EGR gas is continuously recirculated into the intake manifold 3, and consequently, if the control of the recirculating operation of the EGR gas is carried out in a normal manner, the second temperature $T_2$ detected when the count value D becomes equal to MAX becomes considerably high. Therefore, where the control of the recirculating operation of the EGR gas is carried out in a normal manner, the temperature T is considerably raised by the time the count value D becomes equal to MAX from the time that the count value C is MIN. Conversely, where the supply of the EGR gas is stopped for some reason, although the engine is operating in a state where the EGR gas is to be recirculated, the temperature T is kept almost unchanged by the time the count value D becomes equal to MAX from the time the count value C is MIN. Consequently, if the difference between the first temperature $T_1$ detected when the count value C is MIN and the second temperature $T_2$ detected when the count value D is MAX is greater than a fixed value it can be determined that control of the supply of the EGR gas is carried out in a normal manner and, if the difference in the temperature T is smaller than a fixed value, it can be determined that a malfunction has occurred in the EGR device.

Figure 7:
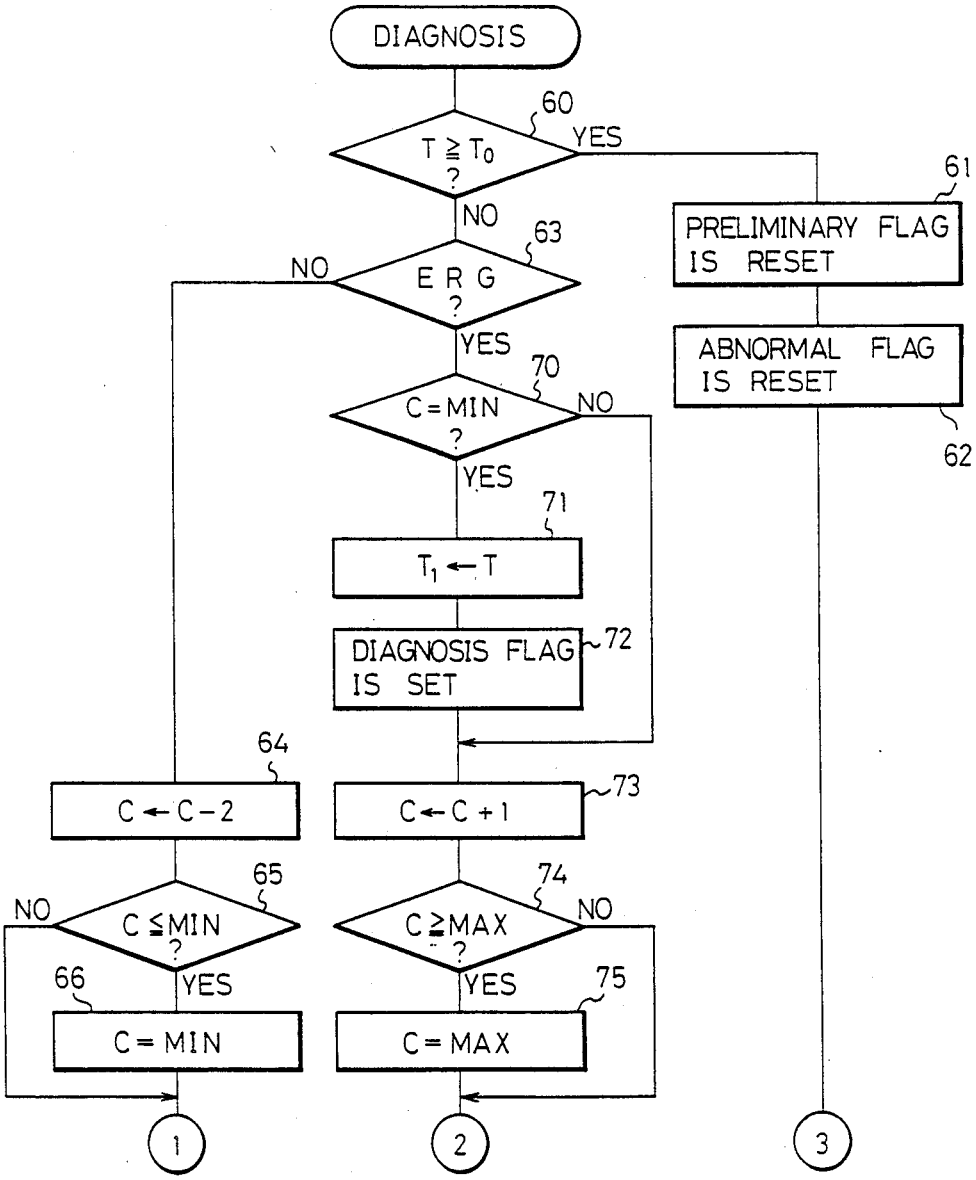
FIGS. 7 and 8 constitute a flow chart for executing the diagnostic method illustrated in the time chart of FIG. 6.
Figure 8:
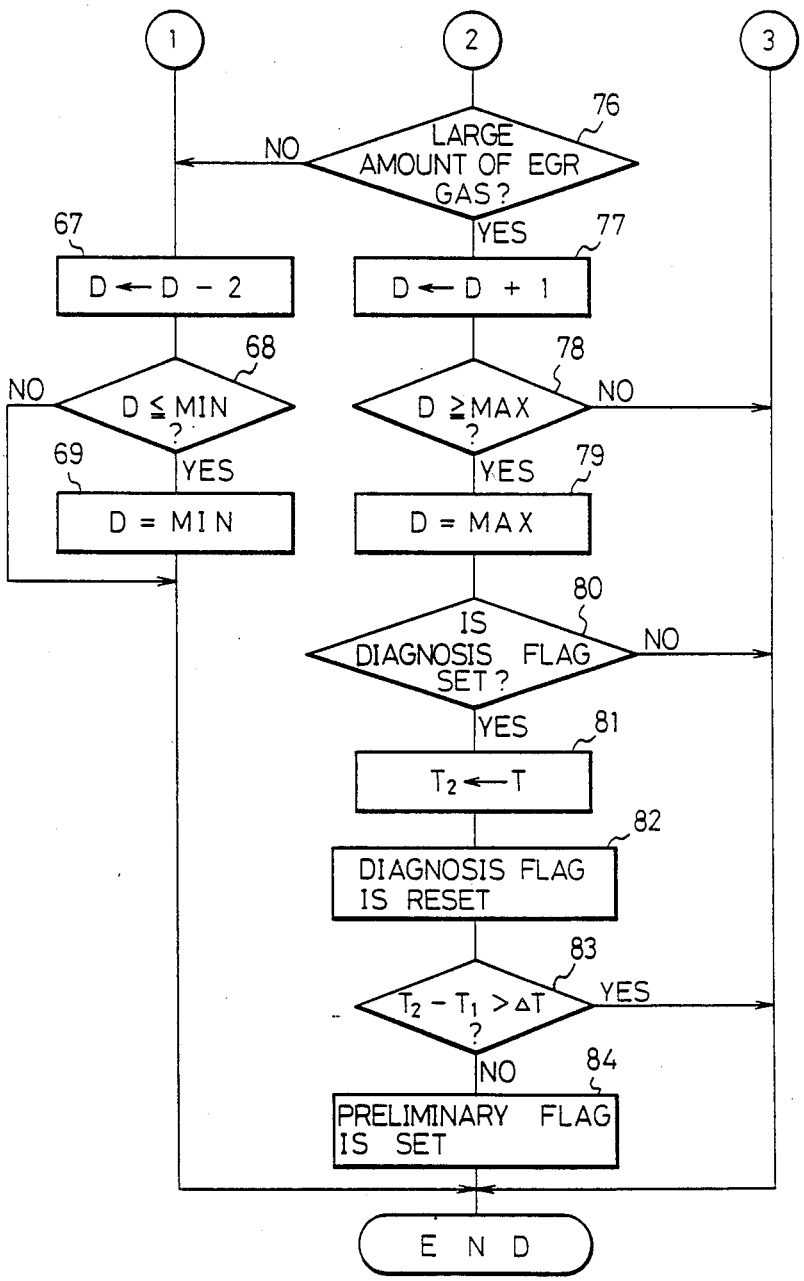

FIGS. 7 and 8 constitute a flow chart for carrying out the diagnostic method described on the basis of FIG. 6. The routine illustrated in FIGS. 7 and 8 is processed by sequential interruptions which are executed at predetermined times.

Referring to FIGS. 7 and 8, in step 60, it is determined whether the temperature T detected by the exhaust gas temperature sensor 17 is higher than a predetermined fixed temperature $T_0$, for example, 60° C. If $T \geqq T_0$, the recirculating operation of the EGR gas is carried out. Consequently, at this time, in steps 61 and 62, a hereinafter described preliminary flag and abnormal flag are reset, respectively, and then the processing cycle is completed. If $T < T_0$, the routine goes to step 63, and it is determined whether the engine is operating in a state where the recirculation of the EGR gas is to be carried out on the basis of the signals output from the air flow meter 6, the suction air temperature sensor 19, the throttle switch 52, the cooling water temperature sensor 23, and the vehicle speed sensor 25.

It is determined that the engine is operating in a state where the EGR gas is to be recirculated when, for example, the following conditions are all satisfied.

(i) The temperature of the cooling water is higher than 60° C.

(ii) The temperature of the suction air is higher than 0° C.

(iii) The throttle switch 52 is OFF. That is, the engine operating state is neither an idling state or a decelerating state.

(iv) The basic amount of fuel to be injected is lower than a fixed amount. That is, the engine operating state is not a full-load operating state. The basic amount of fuel to be injected is calculated from the signals output from the air flow meter 6 and the engine speed sensor 51.

When the conditions (i), (ii), (iii) and (iv) are all satisfied, the EGR control valve 9 is controlled by a separate processing routine (not shown) so that the amount of the EGR gas recirculated into the intake manifold 3 is increased as the engine load becomes high, and that the amount of the EGR gas recirculated into the intake manifold 3 is increased as the engine speed becomes high.

When the engine is operating in a state where the supply of the EGR gas is to be stopped, the routine goes to step 64, and the count value C is decremented by two. If the count value C becomes lower than MIN, the routine goes from step 65 to step 66, and the counter value C is made MIN. Consequently, when the engine is operating in a state where the supply of the EGR gas is to be stopped, the count value C is gradually decremented, and when the count value C becomes equal to MIN, the count value C is maintained at MIN thereafter. Then, the routine goes to step 67, and the count value D is decremented by two. If the count value D becomes lower than MIN, the routine goes from step 68 to step 69, and the counter value D is made MIN. Consequently, when the engine is operating in a state where the supply of the EGR gas is to be stopped, the count value D is gradually decremented, and when the count value D becomes equal to MIN, the count value D is maintained at MIN thereafter.

If it is determined in step 63 that the engine is operating in a state where the recirculation of the EGR gas is to be carried out, the routine goes to step 70, and it is determined whether the count value C is equal to MIN. If C = MIN, the routine goes to step 71, and the temperature T is memorized as the first temperature $T_1$. Then, in step 72, a diagnosis flag which indicates that the first temperature $T_1$ has already been memorized is set, and in step 73, the count value C is incremented by one. Then, in step 74, it is determined whether the count value C is equal to or larger than MAX. If $C < MAX$, the routine goes to step 76. If $C \geqq MAX$, the routine goes to step 75, and the count value C is made MAX. Consequently, if the count value C is equal to MIN when the operating state of the engine is changed to a state where the recirculation of the EGR gas is to be carried out, the temperature T at the time of this change is memorized as the first temperature $T_1$. Subsequently, since the routine jumps from step 70 to step 73, the count value C is gradually increased, until the count value C reaches MAX.

In step 76, it is determined whether the engine is operating in a state where a large amount of the EGR gas is to be recirculated. For example, it is determined whether the vehicle speed is higher than a predetermined speed $V_0$ (FIG. 6) on the basis of the signal output from the vehicle speed sensor 25. Note, it may be determined whether a large amount of the EGR gas is recirculated into the intake manifold 3 by determining whether the engine load is higher than a predetermined load, or by determining whether the engine speed is higher than a predetermined speed, or by determining whether the amount of suction air is larger than a predetermined amount.

When the vehicle speed V is lower than the predetermined speed $V_0$, that is, when a large amount of the EGR gas is not recirculated into the intake manifold 3, the routine goes to step 67, and the count value D is decremented. Conversely, when the vehicle speed V is higher than the predetermined speed $V_0$, that is, when a large amount of the EGR gas is recirculated into the intake manifold 3, the routine goes to step 77, and the count value D is incremented by one. Then, in step 78, it is determined whether the count value D is equal to or larger than MAX. If $D < MAX$, the processing cycle is completed. If $D \geqq MAX$, the routine goes to step 79, and the count value D is made MAX. Consequently, when the operating state of the engine is changed to a state where a large amount of the EGR gas is to be recirculated, the count value D is gradually increased and, when the count value D reaches MAX, the count value D is maintained at MAX thereafter.

When the count value D becomes equal to MAX, the routine goes from step 79 to step 80, and it is determined whether the diagnosis flag is set. Since the diagnosis flag is set if the first temperature $T_1$ has been memorized in step 71, the routine goes to step 81, and the temperature T is memorized as the second temperature $T_2$. Consequently, this second temperature $T_2$ indicates the temperature detected when the count value D becomes equal to MAX. Then, in step 82, the diagnosis flag is reset, and in step 83, it is determined whether the difference $(T_2 - T_1)$ between the second temperature $T_2$ detected when the count value D becomes equal to MAX and the first temperature $T_1$ detected when the count value C is equal to MIN is greater than a predetermined fixed value $\Delta T$. If $(T_2 - T_1) > \Delta T$, the processing routine is completed via step 80. Conversely, if $(T_2-T_1) \leqq \Delta T$, the routine goes to step 86, and the preliminary flag is set. It is possible to light the warning lamp 28 when the preliminary flag is set. However, in this alternative embodiment, in order to correctly determine whether a malfunction has actually occurred in the EGR device, when the ignition switch 50 is made OFF and then again made ON, if the preliminary flag is again set, it is determined that a malfunction has occurred in the EGR device, and the warning lamp 28 is lit.

Figure 9:
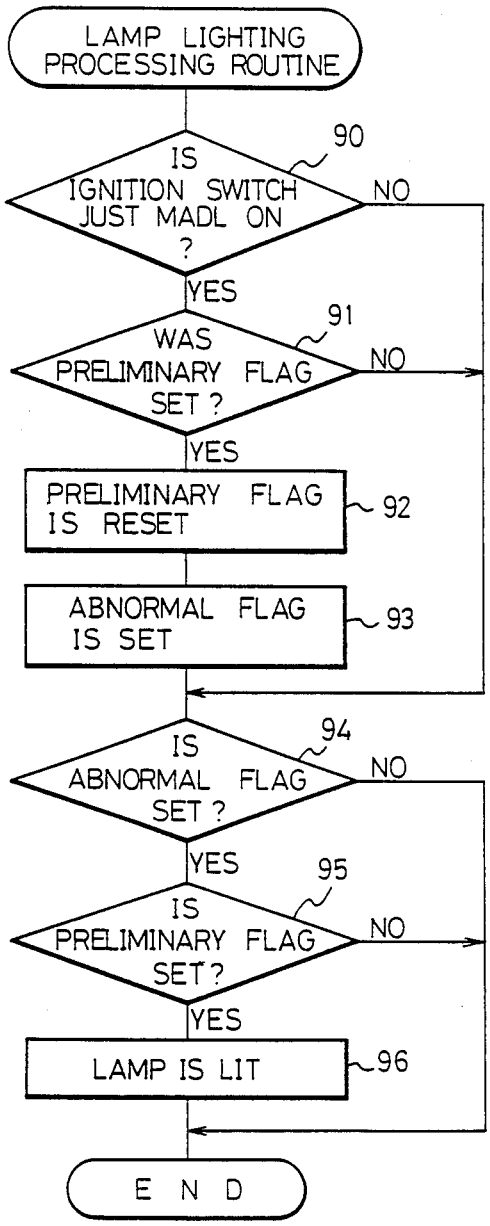
FIG. 9 is a flow chart for executing the process for lighting a warning lamp.

FIG. 9 illustrates the processing routine for lighting the warning lamp 28. This routine is processed by sequential interruptions which are executed at predetermined times.

Referring to FIG. 9, in step 90, it is determined whether the ignition switch 50 is just made ON. When the ignition switch 50 is just made ON, the routine goes to step 91, and it is determined whether the preliminary flag was set during the preceding operation of the engine. If the preliminary flag was set, the routine goes to step 92, and the preliminary flag is reset. Then, in step 93, the abnormal flag is set and the routine goes to step 94. Conversely, if the ignition switch 50 is ON, but not just made ON, the routine jumps from step 90 to step 94. In step 94, it is determined whether the abnormal flag is set. If the abnormal flag is set, the routine goes to step 95, and it is determined whether the preliminary flag is set again. If the preliminary flag is set again, the warning lamp 28 is lit. That is, when the preliminary flag was set during the preceding operation of the engine, and when the preliminary flag is also set during the present operation of the engine, the routine goes from step 95 to step 96, and the warning lamp 28 is lit.

As mentioned above, when it is determined that the temperature T in the EGR passage 8 becomes equal to or higher than $T_0$ in step 60 of FIG. 7, since the preliminary flag and the abnormal flag are reset in steps 61 and 62, respectively, the warning lamp 28 is turned OFF.

According to the present invention, it is possible to correctly determine whether a malfunction has occurred in the ERR device even if the temperature of the exhaust gas is low.

While the invention has been described by reference to specific embodiments chosen for purposes of illustration, it should be apparent that numerous modifications could be made thereto by those skilled in the art without departing from the basic concept and scope of the invention.

I claim:

1. A diagnostic system of an exhaust gas recirculation device having an exhaust gas recirculation control valve which is arranged in an exhaust gas recirculation passage interconnecting an exhaust passage to an intake passage of an internal combustion engine, said diagnostic system comprising:

first determining means of determining whether the engine is operating in a state at which the recirculation of exhaust gas is to be carried out;

detecting means for detecting a temperature in the exhaust gas recirculation passage downstream of the exhaust gas recirculation control valve;

count means having a count value which is variable between a predetermined first value and a predetermined second value in response to a result of a determination by said first determining means, said count value being changed from said first value toward said second value when the engine is operating in a state where the recirculation of exhaust is to be carried out;

means for storing a first temperature detected by said detecting means when said count value is equal to said first value; and second determining means for obtaining a difference between said first temperature and second temperature detected by said detecting means when said count value becomes equal to said second value, to thereby determine that a malfunction has occurred in the exhaust gas recirculation device when said difference is lower than a predetermined value.

2. A diagnostic system according to claim 1, wherein said first determining means determines that the engine is operating in a state where the recirculation of exhaust gas is to be carried out when the engine is operating in a state other than a decelerating operation state.

3. A diagnostic system according to claim 1, wherein said first determining means determines that the engine is operating in a state where the recirculation of exhaust gas is to be carried out when the engine is operating in a state other than an accelerating operation state.

4. A diagnostic system according to claim 1, wherein said first determining means determines that the engine is operating in a state where the recirculation of exhaust gas is to be carried out when the engine is operating in a state other than an accelerating operation state under a full load.

5. A diagnostic system according to claim 1, wherein said first determining means determines that the engine is operating in a state where the recirculation of exhaust gas is to be carried out when the engine is operating in a state other than an idling operating state.

6. A diagnostic system according to claim 1, wherein the exhaust gas recirculation control valve is controlled so that the amount of the exhaust gas recirculated into the intake passage increases as an engine load becomes high.

7. A diagnostic system according to claim 1, wherein said first value is a minimum value, and said second value is a maximum value which is larger than said minimum value, the count value of said count means being incremented when the engine is operating in a state where the recirculation of exhaust gas is to be carried out.

8. A diagnostic system according to claim 7, wherein said count means comprises a single counter, the counter value of said counter being decremented when the engine is operating in a state where the recirculation of exhaust gas is to be stopped.

9. A diagnostic system according to claim 7, wherein said count means comprises a first counter and a second counter, the count value of said first counter being incremented independently of the amount of exhaust gas recirculated into the intake passage when the engine is operating in a state where the recirculation of exhaust gas is to be carried out, the count value of said second counter being incremented when the engine is operating in a state where a large amount of exhaust gas is to be recirculated into the intake passage, said first temperature being detected when the count value of said first counter is equal to said minimum value, said second temperature being detected when the count value of said second counter becomes equal to said maximum value.

10. A diagnostic system according to claim 9, wherein the count value of said first counter is decremented when the engine is operating in a state where the recirculation of exhaust gas is to be stopped.

11. A diagnostic system according to claim 10, wherein the speed of the decrementing of said first counter is higher than the speed of the incrementing thereof.

12. A diagnostic system according to claim 9, wherein the count value of said second counter is decremented when the engine is operating in a state where a large amount of exhaust gas is not to be recirculated into the intake passage.

13. A diagnostic system according to claim 12, wherein the speed of said incrementing of said second counter is higher than the speed of said incrementing thereof.

14. A diagnostic system according to claim 9, further comprising third determining means for determining whether the engine is operating in a state where a large amount of exhaust gas is to be recirculated into the intake passage.

15. A diagnostic system according to claim 14, wherein said third determining mean determines that the engine is operating in a state where a large amount of exhaust gas is to be recirculated into the intake passage when a vehicle speed is higher than a predetermined speed.

16. A diagnostic system according to claim 1, wherein said storing means stores said first temperature detected immediately before the time when the count value of said count means becomes higher than said first value.

17. A diagnostic system according to claim 1, wherein said second determining means determines that a malfunction has occurred in the exhaust gas recirculation device when said difference between said first temperature and said second temperature is lower than a predetermined value both in a preceding operation of the engine and in a present operation of the engine.

18. A diagnostic system according to claim 1, further comprising means for warning a driver when said difference between said first temperature and said second temperature is lower than said predetermined value.

19. A diagnostic system according to claim 18, wherein said warning means comprises a warning lamp.

20. A diagnostic system according to claim 1, further comprising fourth determining means for determining whether a temperature detected by said detecting means is higher than a predetermined temperature to determine whether a malfunction has occurred in the exhaust gas recirculation device when the temperature detected by said detecting means is higher than a predetermined temperature.

* * * * *

UNITED STATES PATENT AND TRADEMARK OFFICE

CERTIFICATE OF CORRECTION

PATENT NO. : 4,793,318

DATED : 27 December 1988

INVENTOR(S) : Shinji TSURUSAKI

It is certified that error appears in the above-identified patent and that said Letters Patent is hereby corrected as shown below:

| Column | Line | |
|---|---|---|
| 4 | 10 | After "17" change "i" to --is--. |
| 5 | 56 | Change "int" to --into--. |
| 6 | 10 | Change "operation" to --operating--. |
| 6 | 32 | Change "MA" to --MAX--. |
| 6 | 40 | Change "tee to --the--. |
| 6 | 68 | After "value" insert --,--. |
| 9 | 42 | Change "ERR" to --EGR--. |
| 10 | 7 | Before "second" insert --a--. |

Signed and Sealed this

Fifteenth Day of August, 1989

*Attest:*

*Attesting Officer*

DONALD J. QUIGG

*Commissioner of Patents and Trademarks*